US011410600B2

(12) United States Patent
Sun et al.

(10) Patent No.: US 11,410,600 B2
(45) Date of Patent: Aug. 9, 2022

(54) PIXEL DRIVING CIRCUIT AND METHOD, DISPLAY APPARATUS

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Jia Sun, Beijing (CN); Xu Lu, Beijing (CN); Xianyong Gao, Beijing (CN); Fanjian Zeng, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 261 days.

(21) Appl. No.: 16/499,526

(22) PCT Filed: Feb. 25, 2019

(86) PCT No.: PCT/CN2019/076045
§ 371 (c)(1),
(2) Date: Sep. 30, 2019

(87) PCT Pub. No.: WO2019/242319
PCT Pub. Date: Dec. 26, 2019

(65) Prior Publication Data

US 2021/0335237 A1 Oct. 28, 2021

(30) Foreign Application Priority Data

Jun. 22, 2018 (CN) ..... 201810654291.4

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3266; G09G 3/3275; G09G 2310/0278; G09G 2320/0233
See application file for complete search history.

(56) References Cited

U.S. PATENT DOCUMENTS 9,123,291 B2 * 9/2015 Duan ..... G09G 3/3225
9,224,329 B2 * 12/2015 Kim ..... G09G 3/3225
9,478,164 B2 10/2016 Ma

FOREIGN PATENT DOCUMENTS

CN 1734546 A 2/2006
CN 101996579 A 3/2011
(Continued)

OTHER PUBLICATIONS

Third Office Action dated Nov. 17, 2020 for application No. CN201810654291.4 with English translation attached.
(Continued)

*Primary Examiner* — Stacy Khoo
(74) *Attorney, Agent, or Firm* — Nath, Goldberg & Meyer; Joshua B. Goldberg

(57) ABSTRACT

The present disclosure relates to the field of display technology, and in particular, to a pixel driving circuit, a pixel driving method, and a display apparatus. The pixel driving circuit includes: a first input device, a second input device, a driving transistor, a compensation sub-circuit, an isolation device, a reset device, and an energy storage device. The
(Continued)

disclosure can eliminate the influence of the threshold voltage of the driving transistor and the voltage drop of the wire due to impedance on the driving current, ensuring that the driving currents output by the pixel driving circuits are uniform, thereby ensuring the uniformity of the display brightnesses of the pixel units, and furthermore, the first pole of the light-emitting device is reset to eliminate the influence of the signal of previous frame.

20 Claims, 3 Drawing Sheets

(52) U.S. Cl.
CPC ..... *G09G 2310/0278* (2013.01); *G09G 2320/0233* (2013.01)

(56) References Cited

FOREIGN PATENT DOCUMENTS

| | | | |
|---|---|---|---|
| CN | 103000133 | A | 3/2013 |
| CN | 103150991 | A | 6/2013 |
| CN | 103578405 | A | 2/2014 |
| CN | 104050918 | A | 9/2014 |
| CN | 104240634 | A | 12/2014 |
| CN | 104464638 | A | 3/2015 |
| CN | 105489168 | A | 4/2016 |
| CN | 106504701 | A | 3/2017 |
| CN | 107346654 | A | 11/2017 |
| CN | 107767819 | A | 3/2018 |
| CN | 107909966 | A | 4/2018 |
| CN | 108538249 | A | 9/2018 |
| KR | 20140086466 | A | 7/2014 |

OTHER PUBLICATIONS

First Office Action dated Aug. 5, 2019 corresponding to Chinese application No. 201810654291.4.

* cited by examiner

PIXEL DRIVING CIRCUIT AND METHOD, DISPLAY APPARATUS

CROSS-REFERENCE TO RELATED APPLICATION

This is a National Phase Application filed under 35 U.S.C. 371 as a national stage of PCT/CN2019/076045, filed Feb. 25, 2019, an application claiming the benefit of Chinese Patent Publication No. 201810654291.4, filed on Jun. 22, 2018, the content of each of which is hereby incorporated by reference in its entirety.

TECHNICAL FIELD

The present disclosure relates to the field of display technology, and in particular, to a pixel driving circuit, a pixel driving method, and a display apparatus.

BACKGROUND

As current-type light-emitting devices, Organic Light Emitting Diodes (OLEDs) are increasingly used in the high-performance display field for its characters of self-illumination, fast response, wide viewing angle, and its ability to be fabricated on a flexible substrate. OLED display apparatuses can be classified into two types: PMOLED (Passive Matrix Driving OLED) display apparatuses and AMOLED (Active Matrix Driving OLED) display apparatuses. AMOLED display apparatuses have attracted increasingly wide attention from display technology developers due to its low manufacturing cost, fast response speed, power saving, applicability to DC driving for portable apparatuses, and wide operation temperature range.

SUMMARY

Embodiments of the present disclosure provide a pixel driving circuit, which includes: a first input device, which is coupled to a first node, a first scan signal line and a data line, and is configured to input a data signal provided by the data line to the first node under the control of a first scan signal provided by the first scan signal line; a second input device, which is coupled to the first node, a second scan signal line and a second power terminal, and is configured to provide a second power signal provided by the second power terminal to the first node under the control of a second scan signal provided by the second scan signal line; a driving transistor having a control electrode coupled to a second node, a first electrode coupled to a third node, and a second electrode coupled to a first pole of a light-emitting device, which is configured to output, under the control of signal at the second node and under the action of signal at the third node, a driving current to the light-emitting device to drive the light-emitting device to emit light; a compensation sub-circuit, which is coupled to the second node, the first node, the first scan signal line, and the third node, and is configured to write a threshold voltage of the driving transistor to the second node under the control of the first scan signal provided by the first scan signal line, and write a sum of a data voltage and the threshold voltage of the driving transistor to the second node under control of a second scan signal provided by the second scan signal line; an isolation device, which is coupled to the third node, a first power terminal, and the second scan signal line, and is configured to transmit a first power signal provided by the first power terminal to the third node under the control of the second scan signal provided by the second scan signal line; a reset device, which is coupled to the second electrode of the driving transistor, the first pole of the light-emitting device, and the second power terminal, and is configured to transmit a second power signal provided by the second power terminal to the first pole of the light-emitting device under the control of the first scan signal provided by the first scan signal line, wherein a second pole of the light-emitting device is coupled to the second power terminal.

In some implementations, the compensation sub-circuit includes: a third switching element having a control terminal coupled to the first scan signal line, a first terminal coupled to the third node, and a second terminal coupled to the second node; and a storage capacitor having a first end coupled to the first node and a second end coupled to the second node.

In some implementations, the first input device includes: a first switching element having a control terminal coupled to the first scan signal line, a first terminal coupled to the data signal line, and a second terminal coupled to the first node.

In some implementations, the second input device includes: a second switching element having a control terminal coupled to the second scan signal line, a first terminal coupled to the first node, and a second terminal coupled to the second power terminal.

In some implementations, the isolation device includes: a fourth switching element having a control terminal coupled to the second scan signal line, a first terminal coupled to the first power terminal and a second terminal coupled to the third node.

In some implementations, the reset device includes: a fifth switching element having a control terminal coupled to the first scan signal line, a first terminal coupled to the first pole of the light-emitting device, and a second terminal coupled to the second power terminal.

In some implementations, the first switching element, the second switching element, the third switching element, the fourth switching element and the fifth switching element are thin film transistors.

In some implementations, the pixel driving circuit is coupled to scan signal lines of the $N^{th}$ row and the $(N+1)^{th}$ row, wherein the scan signal line of the $N^{th}$ row is configured to output the first scan signal, and the scan signal line of the $(N+1)^{th}$ row is configured to output the second scan signal, N is a positive integer.

Embodiments of the present disclosure provide a pixel driving method for driving the above pixel driving circuit, wherein the pixel driving method includes a reset stage, a compensation stage, a buffer stage, and a light-emitting stage, and wherein:

during the reset stage, the first input device, the compensation device, and the reset device are turned on under the control of the first scan signal, and the second input device and the isolation device are turned on under the control of the second scan signal, the reset device resets the first pole of the light-emitting device by using the second power signal, the first input device inputs the data signal to the first node, and the second input device inputs the first power signal to the second node;

during the compensation stage, the first input device, the compensation device, and the reset device are turned on under the control of the first scan signal, and a signal at the second node is discharged to a threshold voltage of the driving transistor through the compensation device, the driving transistor and the reset device;

during the buffer stage, the first switching device, the compensation device, and the reset device are turned off under the control of the first scan signal, and the second input device and the isolation device are turned off under the control of the second scan signal, and the signals at the first node and the second node remain unchanged;

during the light-emitting stage, the second input device and the isolation device are turned on under the control of the second scan signal, and the data signal at the first node is written into the second node, so that the signal at the second node jumps to a sum of the data signal and the threshold voltage of the driving transistor, and the driving transistor is turned on under the control of the signal at the second node, and outputs a driving current under the control of the signal at the third node.

Embodiments of the present disclosure provide a display panel including the above pixel driving circuit.

Embodiments of the present disclosure provide a display apparatus including the above display panel.

BRIEF DESCRIPTION OF THE DRAWINGS

The above and other features and advantages of the present disclosure will become more apparent from the detailed description of exemplary embodiments with reference to accompanying drawings. Apparently, the drawings in the following description are only some of the embodiments of the present disclosure, and from which other drawings may be obtained by those skilled in the art without creative labor. In the drawings.

DETAILED DESCRIPTION

Figure 1:
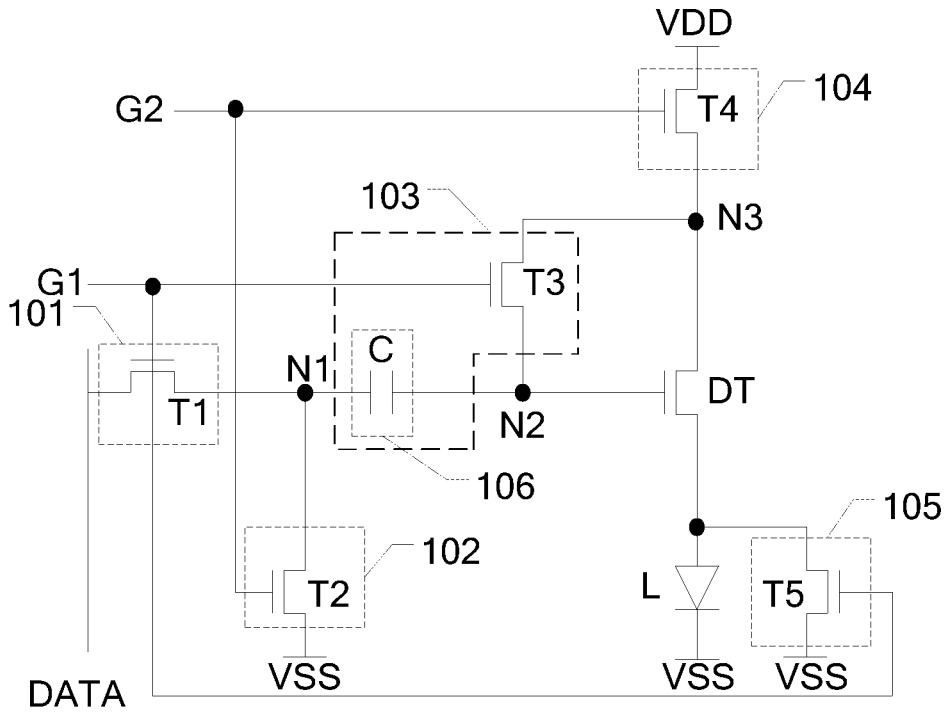
FIG. 1 is a schematic diagram of a pixel driving circuit according to an exemplary embodiment of the present disclosure.

In an AMOLED display panel of the related art, each of the pixel units is supplied with a driving current by an independent pixel driving circuit. Driving transistors in pixel driving circuits have a problem of drift and inconsistency in threshold voltages thereof due to manufacturing process differences and long-time operation, etc., thereby causing the driving currents outputted by the respective pixel driving circuits to be inconsistent, leading to an non-uniformity of light-emitting of the pixel units in the display panel. In addition, since the lengths of wires between the respective pixel driving circuits and a driving IC that outputs a power supply voltage are different, the difference in the wire impedances caused by the difference in the lengths of the wires causes the power supply voltages obtained by the pixel driving circuits to be different, therefore, in a case where a same data signal voltage is input, different pixel units may have different currents flowed therethrough, resulting in different brightnesses of different pixel units, so that light-emitting of the pixel units in the display panel are non-uniform.

Accordingly, it is desirable to provide a pixel driving circuit capable of overcoming non-uniform display brightnesses of the pixel units caused by the threshold voltages of the driving transistors and the impedances of the wires.

Exemplary embodiments will be described more fully hereinafter with reference to the accompanying drawings. However, the exemplary embodiments can be embodied in a variety of forms and should not be construed as being limited to the embodiments set forth herein. In contrast, theses embodiments are provided to disclose the present disclosure fully and completely, and convey the concept of these embodiments to those skilled in the art. The described features, structures, or characteristics may be combined in any suitable manner in one or more embodiments. In the following description, numerous specific details are set forth so as to provide full understanding of the embodiments of the present disclosure. However, any skilled in the art will appreciate that the technical solutions of the present disclosure may be practiced without one or more of the specific details, or other methods, components, materials, devices, steps, etc. may be employed. In other instances, well-known technical solutions are not shown or described in detail to avoid obscuring aspects of the present disclosure.

In addition, the drawings are merely schematic illustrations of the present disclosure, and are not necessarily drawn to scale. The same reference numerals in the drawings denote the same or similar parts, and the repeated description thereof will be omitted.

An exemplary embodiment of the present disclosure provides a pixel driving circuit for driving a light-emitting device to emit light. As shown in FIG. 1, the pixel driving circuit may include a first input device 101, a second input device 102, a driving transistor DT, a compensation sub-circuit T3, an isolation device 104, and a reset device 105. The compensation sub-circuit T3 includes a compensation device T3 and an energy storage device 106. The first input device 101 may be a first switching device 101 and the second input device 102 may be a second switching device. As can be seen from FIG. 1, the first switching device 101 is coupled to a first node N1, a first scan signal line and a data line, and is turned on under the control of a first scan signal G1 to input a data signal DATA provided by the data line to the first node N1. The second switching device 102 is coupled to the first node N1, a second scan signal line and a second power terminal, and is turned on under the control of a second scan signal G2 provided by the second scan signal line to input a second power signal VSS provided by the second power terminal to the first node N1. A control electrode of the driving transistor DT is coupled to a second node N2, a first electrode of the driving transistor DT is coupled to a third node N3, a second electrode of the driving transistor DT is coupled to a first pole of the light-emitting device, and the driving transistor DT is turned on under the control of a signal at the second node N2, and outputs a driving current under the action of a signal at the third node N3 to drive the light-emitting device L to emit light. The compensation sub-circuit 103 is coupled to the second node N2, the first node N1, the first scan signal line, and the third node N3, and may be turned on under the control of the first scan signal G1 to write a threshold voltage VTH of the driving transistor DT to the second node N2. Furthermore, the compensation sub-circuit 103 is further capable of writing, under the control of the second scan signal G2 provided by the second scan signal line, a sum of the data voltage DATA and the threshold voltage VTH of the driving transistor to the second node N2. The isolation device 104 is coupled to the third node N3, a first power terminal, and the second scan signal line, and is turned on under the control of the second scan signal G2 to transmit a first power signal VDD provided by the first power terminal to the third node N3. The reset device 105 is coupled to the second electrode of the driving transistor DT, the first pole of the light-emitting device L, and the second power terminal, and is turned on under the control of the first scan signal G1 to transmit a second power signal VSS to the first pole of the light-emitting device L. A second pole of the light-emitting device L is also coupled to the second power terminal. Furthermore, the compensation device T3 is coupled to the first scan signal line, the third node N3 and the second node N2, the energy storage device 106 is coupled between the first node N1 and the second node N2, and is capable of storing the data signal DATA and the threshold voltage VTH of the driving transistor DT.

During the operation of the pixel driving circuit, on one hand, during a compensation stage, by turning on the compensation device T3 and the reset device 105, the signal at the second node N2 is discharged to the threshold voltage VTH of the driving transistor DT through the compensation device T3, the driving transistor DT and the reset device 105, that is, the threshold voltage VTH of the driving transistor DT is written to the second node N2 to compensate the threshold voltage of the driving transistor DT, thereby eliminating the influence of the threshold voltage VTH of the driving transistor DT on the driving current, thus ensuring that the driving currents outputted by the respective pixel driving circuits are uniform, thereby ensuring the uniformity of the brightnesses of the pixel units. On another hand, since the driving current outputted by the pixel driving circuit is independent of the first power signal VDD, the influence of the voltage drop due to wire impedances on the brightnesses of the pixel units is eliminated, ensuring that the driving currents output by the pixel driving circuits are uniform, and the uniformity of brightnesses of the pixel units is ensured. On still another hand, in a reset stage, the second power signal VSS is transmitted the first pole of the light-emitting device L through the reset device 105 by turning on the reset device 105, to reset the first pole of the light-emitting device L so as to eliminate the influence of the signal of previous frame. On further another hand, since the light-emitting device L is driven to emit light only in the light-emitting stage, the light-emitting device L does not emit light in other stages, thereby increasing the contrast of the pixel unit. Meanwhile, since the timing chart of the pixel driving circuit is simple, the anti-interference ability thereof is strong. Furthermore, during the reset stage, by turning on the isolation device 104 and the compensation device T3, the first power signal VDD is transmitted to the second node N2 to charge the energy storage device 106, that is, to charge the energy storage device 106 by the first power signal VDD, which greatly shortens the charging time and improves the charging efficiency.

Hereafter, as shown in FIG. 1, a case where the first switching device 101 includes a first switching element T1, the second switching device 102 includes a second switching element T2, the compensation device T3 includes a third switching element T3, and the isolation device 104 includes a fourth switching element T4, the reset device 105 includes a fifth switching element T5, the energy storage device 106 includes a storage capacitor C, and the first to fifth switching elements (T1 to T5) and the driving transistor DT each includes a control terminal, a first terminal and a second terminal is taken as an example to explain the specific structure and coupling manner of the above pixel driving circuit.

The control terminal of the first switching element T1 receives the first scan signal G1, the first terminal of the first switching element T1 receives the data signal DATA, and the second terminal of the first switching element T1 is coupled to the first node N1. The control terminal of the second switching element T2 receives the second scan signal G2, the first terminal of the second switching element T2 is coupled to the first node N1, and the second terminal of the second switching element T2 receives the second power signal VSS. The control terminal of the driving transistor DT is coupled to the second node N2, the first terminal of the driving transistor DT is coupled to the third node N3, and the second terminal of the driving transistor DT is coupled to the first pole of the light-emitting device L. The control terminal of the third switching element T3 receives the first scan signal G1, the first terminal of the third switching element T3 is coupled to the third node N3, and the second terminal of the third switching element T3 is coupled to the second node N2. The control terminal of the fourth switching element T4 receives the second scan signal G2, the first terminal of the fourth switching element T4 receives the first power signal VDD, and the second terminal of the fourth switching element T4 is coupled to the third node N3. The control terminal of the fifth switching element T5 receives the first scan signal G1, the first terminal of the fifth switching element T5 is coupled to the first pole of the light-emitting device L, and the second terminal of the fifth switching element T5 receives the second power signal VSS. A first end of the storage capacitor C is coupled to the first node N1, and a second end of the storage capacitor C is coupled to the second node N2.

In the present exemplary embodiment, each of the first to fifth switching elements (T1 to T5) may correspond to the first to fifth switching transistors, respectively. Each of the switching transistors has a control terminal, a first terminal, and a second terminal, respectively. The control terminal of each switching transistor may be a gate, the first terminal of each switching transistor may be a source, and the second terminal of each switching transistor may be a drain; alternatively, the control terminal of each switching transistor may be the gate, the first terminal of each switching transistor may be the drain, and the second terminal of each switching transistor may be the source. For example, in a case where the switching transistors are N-type thin film transistors, that is, the switching elements said above are all N-type thin film transistors (i.e., the first switching element to the fifth switching element (T1 to T5) are N-type thin film transistors), the first terminal of the switching element is the drain, the second terminal of the switching element is the source, and the control terminal of the switching element is the gate. For another example, in a case where the switching transistors are P-type thin film transistors, that is, the switching elements said above are all P-type thin film transistors (i.e., the first switching element to the fifth switching element (T1 to T5) are P-type thin film transistors), the first terminal of the switching element is the source, the second terminal of the switching element is the drain, and the control terminal of the switching element is the gate. The thin film transistor may be any of an amorphous silicon thin film transistor, a polycrystalline silicon thin film transistor, and an amorphous-indium gallium zinc oxide thin film transistor.

In addition, each of the switching transistors may be an enhancement transistor or a depletion transistor, which is not specifically limited in this exemplary embodiment. It should be noted that since the source and the drain of the switching transistor are symmetrical, the source and the drain of the switching transistor may be interchanged.

The driving transistor DT has a control terminal, a first terminal, and a second terminal. For example, the control terminal of the driving transistor DT may be a gate, the first terminal of the driving transistor DT may be a source, and the second terminal of the driving transistor DT may be a drain. For another example, the control terminal of the driving transistor DT may be the gate, the first terminal of the driving transistor DT may be the drain, and the second terminal of the driving transistor DT may be the source. In addition, the driving transistor DT may be an enhancement driving transistor or a depletion driving transistor, which is not particularly limited in this exemplary embodiment.

The type of the storage capacitor C may be selected according to a specific circuit. For example, the storage capacitor C may be a MOS capacitor, a metal capacitor, a double polycrystalline capacitor, or the like, which is not particularly limited in this exemplary embodiment.

The light-emitting device L is a current-driven light-emitting device, which is controlled to emit light by a current flowing through the driving transistor DT, for example, may be an OLED, but the light-emitting device L in the present exemplary embodiment is not limited thereto. Furthermore, the light-emitting device L has a first pole and a second pole. The first pole of the light-emitting device L may be an anode, and the second pole of the light-emitting device L may be a cathode; or the first pole of the light-emitting device L may be a cathode, and the second pole of the light-emitting device L may be an anode.

In a plurality of pixel driving circuits arranged in the array, in order to multiplex the first scan signal G1 and the second scan signal G2 in each pixel driving circuit so as to simplify the circuit structure of the plurality of pixel driving circuits arranged in the array and realize a progressive scanning, the pixel driving circuit is coupled to the $N^{th}$ row and the $(N+1)^{th}$ row of scan signal lines, the $N^{th}$ row of scan signal line is configured to output the first scan signal G1, and the $(N+1)^{th}$ row of scan signal line is configured to output the second scan signal G2, where N is a positive integer. Specifically, the first switching device 101, the compensation device T3, and the reset device 105 in the pixel driving circuit are coupled to the $N^{th}$ row of scan signal line, and the second switching device 102 and the isolation device 104 are coupled to the $(N+1)^{th}$ row of scan signal line.

In an exemplary embodiment of the present disclosure, there is also provided a pixel driving method for driving the pixel driving circuit as shown in FIG. 1. The pixel driving method may include a reset stage, a compensation stage, a buffer stage, and a light-emitting stage.

During the reset stage, the first switching device, the compensation device, and the reset device are turned on by using the first scan signal, and the second switching device and the isolation device are turned on by using the second scan signal, so that the first pole of the light-emitting device is reset by the second power signal through the reset device, the data signal is transmitted to the first node, and the first power signal is transmitted to the second node to charge the energy storage device.

During the compensation stage, the first switching device, the compensation device, and the reset device are turned on by using the first scan signal, so that a signal at the second node is discharged to the threshold voltage of the driving transistor through the compensation device, the driving transistor, and the reset device.

During the buffer stage, the first switching device, the compensation device, and the reset device are turned off by using the first scan signal, and the second switching device and the isolation device are turned off by using the second scan signal, thereby controlling the signals at the first node and the second node to remain unchanged.

During the light-emitting stage, the second switching device and the isolation device are turned on by using the second scan signal, thereby the data signal at the first node is written to the second node, so that the signal at the second node jumps to a sum of the data signal and the threshold voltage of the driving transistor, and the driving transistor is turned on by the signal at the second node, and outputs a driving current under the action of the signal at the third node.

Figure 2:
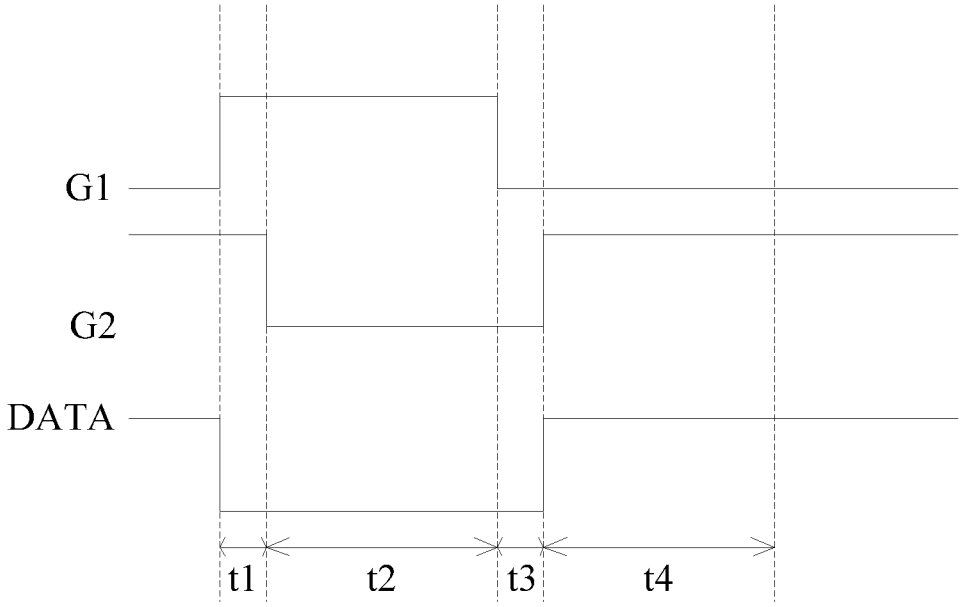
FIG. 2 is an operational timing diagram of a pixel driving circuit according to an exemplary embodiment of the present disclosure.

Next, the operation of the pixel driving circuit of FIG. 1 will be described in detail in conjunction with the operation timing chart of the pixel driving circuit shown in FIG. 2. An example in which the first switching device 101 includes a first switching element T1, the second switching device 102 includes a second switching element T2, the compensation device T3 includes a third switching element T3, and the isolation device 104 includes a fourth switching element T4, the reset device 105 includes a fifth switching element T5, the energy storage device 106 includes a storage capacitor C, and the switching elements are all N-type thin film transistors, that is, the first switching element to the fifth switching element (T1~T5) are N-type thin film transistors is taken. Since the switching elements are all N-type thin film transistors, the first terminal of each switching element is a drain, the second terminal of each switching element is a source, the switching element is turned on by a high level signal, and the switching element is turned off by a low level signal, that is, the first switching device 101, the second switching device 102, the compensation device T3, the isolation device 104, and the reset device 105 are all turned on by a high level signal, the switching device 101, the second switching device 102, the compensation device T3, the isolation device 104, and the reset device 105 are all turned off by a low level signal. The first power signal VDD is a high level signal, and the second power signal VSS is a low level signal. It should be noted that a potential of the second power signal VSS is 0V.

Figure 3:
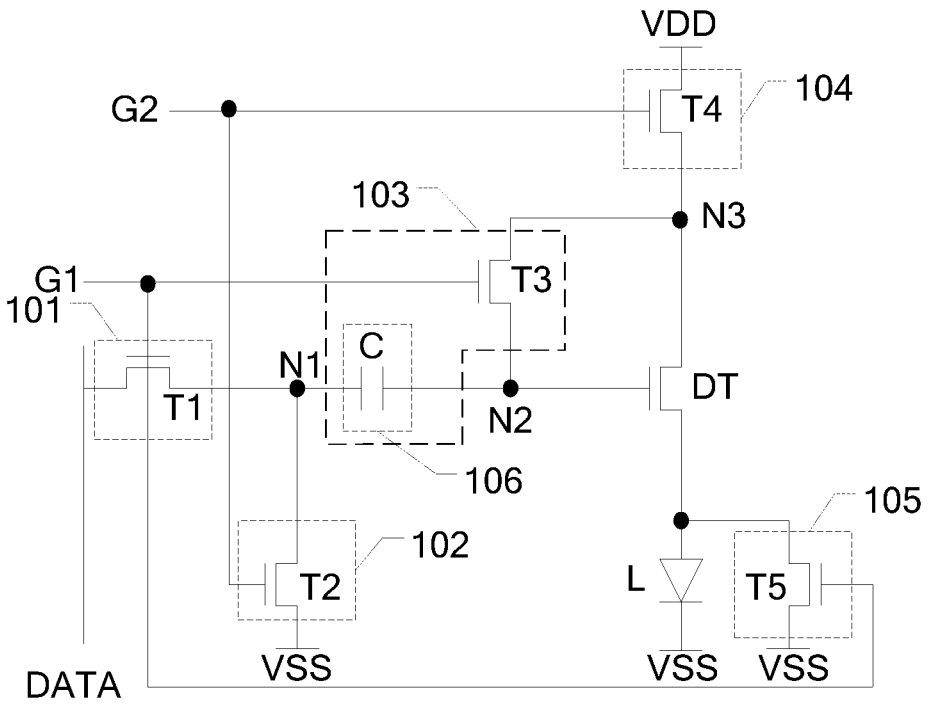
FIG. 3 is an equivalent circuit diagram of a pixel driving circuit in a reset stage according to an exemplary embodiment of the present disclosure.

During the reset stage (i.e., the period t1), the first switching device 101, the compensation device T3, and the reset device 105 are turned on by the first scan signal G1, and the second switching device 102 and the isolation device 104 are turned on by the second scan signal G2, so that the first pole of the light-emitting device L is reset by the second power signal VSS through the reset device 105, the data signal DATA is transmitted to the first node N1, and the first power signal VDD is transmitted to the second node N2 to charge the energy storage device 106. In the present exemplary embodiment, the first scan signal G1 and the second scan signal G2 are both high level signals, as shown in FIG. 3, the first switching device 101, the compensation device T3, the reset device 105, the second switching device 102 and the isolation device 104 are turned on. The first power signal VDD is transmitted to the second node N2 through the isolation device 104 and the compensation device T3 to charge the energy storage device 106, that is, the energy storage device 106 is charged by the first power signal VDD, which greatly shortens the charging time, improves the charging efficiency. At this time, the signal at the second node N2 is the first power signal VDD. The data signal DATA is transmitted to the first node N1 through the first switching device 101 to charge the energy storage device 106, and the signal at the first node N1 is the data signal DATA. The second power signal VSS is transmitted, through the reset device 105, to the first pole of the light-emitting device L to reset the first pole of the light-emitting device L to eliminate the influence of the signal of previous frame.

Figure 4:
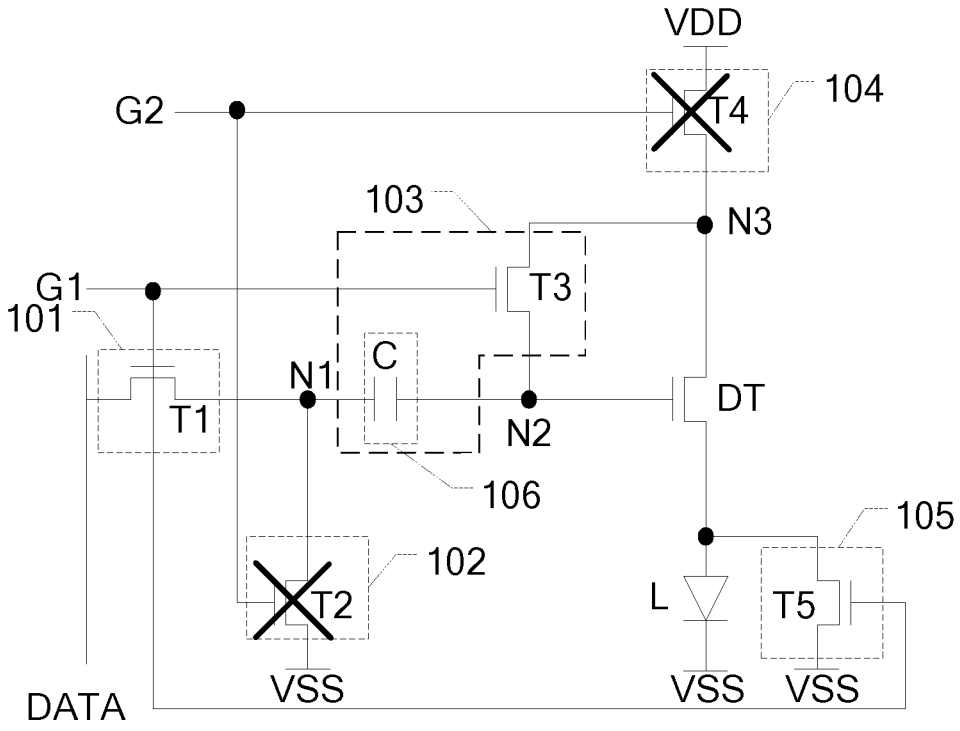
FIG. 4 is an equivalent circuit diagram of a pixel driving circuit in a compensation stage according to an exemplary embodiment of the present disclosure.

During the compensation stage (i.e., the period t2), the first switching device 101, the compensation device T3, and the reset device 105 are turned on by the first scan signal G1, so that the signal at the second node N2 is discharged to the threshold voltage VTH of the driving transistor DT through the compensation device T3, the driving transistor DT and the reset device 105. In the present exemplary embodiment, at this time, the first scan signal G1 is a high level signal, and the second scan signal G2 is a low level signal, as shown in FIG. 4, the first switching device 101, the compensation device T3 and the reset device 105 are turned on, and the second switching device 102 and the isolation device 104 are both turned off. The signal at the second node N2 is discharged to the threshold voltage VTH of the driving transistor DT through the compensation device T3, the driving transistor DT and the reset device 105, that is, the signal at the second node N2 is discharged from the first power signal VDD to the threshold voltage VTH of the driving transistor DT. At this time, since the first switching device 101 is turned on, the signal at the first node N1 is still the data signal DATA.

Figure 5:
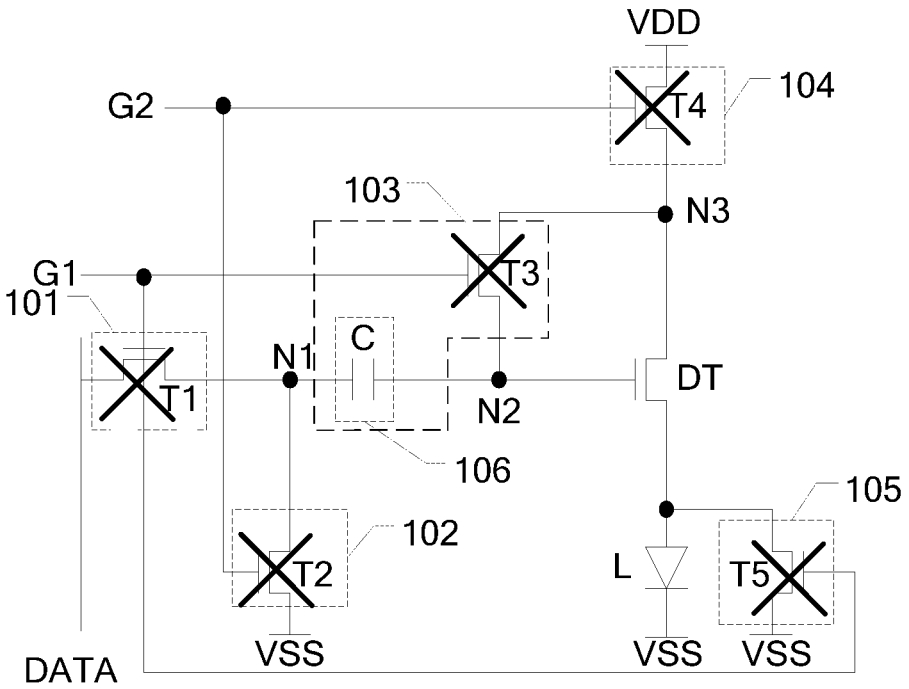
FIG. 5 is an equivalent circuit diagram of a pixel driving circuit in a buffer stage according to an exemplary embodiment of the present disclosure.

During the buffer stage (i.e., the period t3), the first switching device 101, the compensation device T3 and the reset device 105 are turned off by the first scan signal G1, and the second switching device 102 and the isolation device 104 are turned off by the second scan signal G2, the signals at the first node N1 and the second node N2 are controlled to remain unchanged. In the present exemplary embodiment, at this time, the first scan signal G1 and the second scan signal G2 are both at low level, as shown in FIG. 5, the first switching device 101, the second switching device 102, the compensation device T3, the isolation device 104 and the reset device 105 are all turned off. At this time, the signal at the first node N1 is still the data signal DATA, and the signal at the second node N2 remains the threshold voltage VTH of the driving transistor DT.

Figure 6:
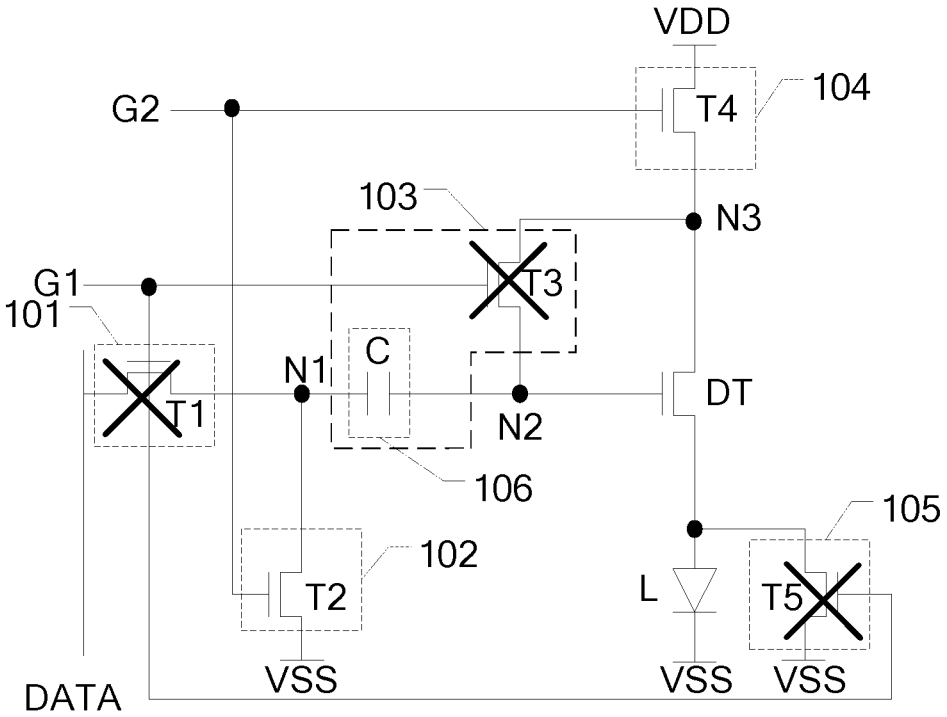
FIG. 6 is an equivalent circuit diagram of a pixel driving circuit in a light-emitting stage according to an exemplary embodiment of the present disclosure.

During the light-emitting stage (i.e., the period t4), the second switching device 102 and the isolation device 104 are turned on by the second scan signal G2, and the data signal DATA at the first node N1 is written to the second node N2, so that the signal at the second node N2 jumps to a sum of the data signal DATA and the threshold voltage VTH of the driving transistor DT, the driving transistor DT is turned on under the action of the signal at the second node N2, and outputs a driving current under the action of the signal at the third node N3. In the present exemplary embodiment, at this time, the first scan signal G1 is at a low level, and the second scan signal G2 is at a high level. As shown in FIG. 6, the second switching device 102 and the isolation device 104 are both turned on, and the first switching device 101, the reset device 105, and the compensation device T3 are all turned off. The first power signal VDD is transmitted to the third node N3 through the isolation device 104, and the second power signal VSS is transmitted to the first node N1 through the second switching device 102, that is, the signal at the first node N1 is abruptly changed from the data signal DATA to the second power signal VSS, that is, the signal at the first node N1 is abruptly changed from the data signal DATA to a potential of 0 V, and the amount of abrupt change of the signal at the first node N1 is |DATA|. Due to the bootstrap action of the storage capacitor C in the energy storage device 106, when the signal at the first node N1 is abruptly changed, the signal at the second node N2 is also abruptly changed accordingly. Therefore, the signal at the second node N2 is abruptly changed to |DATA|+VTH. In this case, the driving transistor DT is turned on by the signal at the second node N2 (i.e., |DATA|+VTH), and outputs a driving current under the action of the signal at the third node N3 (i.e., the first power signal VDD) to drive the light-emitting device L to emit light. At this time, the voltage of the first pole of the light-emitting device L becomes an on-voltage VL of the light-emitting device L.

On this basis, according to the formula for calculating the driving current of the driving transistor DT:

$$\mathrm{Ion} = K \times (Vgs - VTH)^2 = K \times (Vg - Vs - VTH)^2 = K \times (|\mathrm{DATA}| + VTH - VL - VTH)^2 = K \times (|\mathrm{DATA}| - VL)^2$$

Where Vgs is a voltage difference between the gate and the source of the drive transistor DT, Vg is a voltage at the gate of the driving transistor DT, Vs is a voltage at the source of the driving transistor DT, and VTH is the threshold voltage of the driving transistor DT.

It can be seen from above that the driving current is independent of the threshold voltage VTH of the driving transistor DT and the voltage of the first power signal VDD. Therefore, during the compensation stage (i.e., the period t2), by turning on the compensation device T3 and the reset device 105, the signal at the second node N2 is discharged, through the compensation device T3, the driving transistor DT and the reset device 105, to the threshold voltage VTH of the driving transistor DT, that is, the threshold voltage VTH of the driving transistor DT is written to the second node N2 to compensate the threshold voltage VTH of the driving transistor DT, thus eliminating the influence of the threshold voltage VTH of the driving transistor DT on the driving current, ensuring that the driving currents output from the driving circuits are uniform, thereby ensuring the uniformity of the brightnesses of the pixel units. In addition, the influence of the voltage drop of the wires due to impedances on the display brightnesses of the pixel units is eliminated, and the driving currents outputted by the pixel driving circuits are ensured to be uniform, and the display brightnesses of the pixel units are ensured to be uniform. Moreover, since the light-emitting device L is driven to emit light only during the light-emitting stage (i.e., the period t4), the light-emitting device L does not emit light at other stages, thereby increasing the contrast of the pixel units, while anti-interference ability of the pixel driving circuit is strong due to its simple timing chart.

It should be noted that, in the foregoing specific embodiments, all the switching elements are N-type thin film transistors, however, those skilled in the art can easily obtain a pixel driving circuit, all thin film transistors of which are P-type thin film transistors, according to the pixel driving circuit provided by the present disclosure. In an exemplary embodiment of the present disclosure, all of the switching elements may be P-type thin film transistors, and since all of the switching elements are P-type thin film transistors, the first terminal of each switching element is a source, the second terminal of each switching element is a drain. The signals for turning on the switching elements are low level signals. Adopting all P-type thin film transistors has the following advantages: for example, strong noise suppression; for example, since the switching elements are turned on by low level, and low level is easy to be implemented in charging management; for example, a P-type thin film transistor is easily manufactured and low in price; for example, P-type thin film transistors have better stability and the like. Certainly, the pixel driving circuit provided in the present disclosure may also be implemented by a CMOS (Complementary Metal Oxide Semiconductor) circuit or the like, and is not limited to the pixel driving circuit provided in the present embodiment, details of which are not described herein again.

Embodiments of the disclosure also provide a display apparatus including the above-described pixel driving circuit. The display apparatus includes: a plurality of scan lines for providing scan signals; a plurality of data lines for providing data signals; and a plurality of pixel driving circuits electrically coupled to the scan lines and the data lines, at least one of the pixel driving circuits includes any one of the above-described pixel driving circuits in the present exemplary embodiments. The display apparatus may include any product or component having a display function, such as a mobile phone, a tablet computer, a television, a notebook computer, a digital photo frame, a navigator, and the like. During the compensation stage, by turning on the compensation device and the reset device, the signal at the second node is discharged to the threshold voltage of the driving transistor through the compensation device, the driving transistor and the reset device, that is, the threshold voltage of the driving transistor is written to the second node to compensate the threshold voltage of the driving transistor, eliminating the influence of the threshold voltage of the driving transistor on the driving current, ensuring that the driving currents output by the pixel driving circuits are uniform, thereby ensuring uniformity of display brightnesses of the pixel units. In addition, since the driving current outputted by the pixel driving circuit is independent of the first power signal, so the influence of the voltage drop of the wires due to impedances on the display brightnesses of the pixel units is eliminated, the driving currents outputted by the pixel driving circuits are ensured to be uniform, and the uniformity of display brightnesses of the pixel units is ensured. In addition, during the reset stage, the second power signal is transmitted, by turning on the reset device, to the first pole of the light-emitting device through the reset device to reset the first pole of the light-emitting device so as to eliminate the influence of the signal of previous frame. In addition, since the light-emitting device is driven to emit light only during the light-emitting stage, and does not emit light in other stages, thereby increasing the contrast of the pixel units, and meanwhile, because the timing chart of the pixel driving circuit is simple, the anti-interference ability of the pixel driving circuit is strong. In addition, since the isolation device and the compensation device are turned on during the reset stage, the first power signal is transmitted to the second node to charge the energy storage device, that is, the energy storage device is charged by the first power signal, which greatly shortens the charging time and improves the charging efficiency.

What is claimed is:

1. A pixel driving circuit, comprising:

a first input device, which is coupled to a first node, a first scan signal line and a data line, and is configured to input a data signal provided by the data line to the first node under the control of a first scan signal provided by the first scan signal line;

a second input device, which is coupled to the first node, a second scan signal line and a second power terminal, and is configured to provide a second power signal provided by the second power terminal to the first node under the control of a second scan signal provided by the second scan signal line;

a driving transistor having a control electrode coupled to a second node, a first electrode coupled to a third node, and a second electrode coupled to a first pole of a light-emitting device, which is configured to output, under the control of signal at the second node and under the action of signal at the third node, a driving current to the light-emitting device to drive the light-emitting device to emit light;

a compensation sub-circuit, which is coupled to the second node, the first node, the first scan signal line, and the third node, and is configured to write a threshold voltage of the driving transistor to the second node under the control of the first scan signal provided by the first scan signal line, and write a sum of a data voltage and the threshold voltage of the driving transistor to the second node under control of the second scan signal provided by the second scan signal line;

an isolation device, which is coupled to the third node, a first power terminal, and the second scan signal line, and is configured to transmit a first power signal provided by the first power terminal to the third node under the control of the second scan signal provided by the second scan signal line;

a reset device, which is coupled to the second electrode of the driving transistor, the first pole of the light-emitting device, and the second power terminal, and is configured to transmit the second power signal provided by the second power terminal to the first pole of the light-emitting device under the control of the first scan signal provided by the first scan signal line, wherein a second pole of the light-emitting device is coupled to the second power terminal.

2. The pixel driving circuit of claim 1, wherein the compensation sub-circuit comprises:

a switching element having a control terminal coupled to the first scan signal line, a first terminal coupled to the third node, and a second terminal coupled to the second node; and a storage capacitor having a first end coupled to the first node and a second end coupled to the second node.

3. The pixel driving circuit of claim 2, wherein the first input device comprises:

a first switching element having a control terminal coupled to the first scan signal line, a first terminal coupled to the data line, and a second terminal coupled to the first node.

4. The pixel driving circuit of claim 3, wherein the second input device comprises:

a second switching element having a control terminal coupled to the second scan signal line, a first terminal coupled to the first node, and a second terminal coupled to the second power terminal.

5. The pixel driving circuit of claim 4, wherein the isolation device comprises:

a third switching element having a control terminal coupled to the second scan signal line, a first terminal coupled to the first power terminal, and a second terminal coupled to the third node.

6. The pixel driving circuit of claim 5, wherein the reset device comprises:

a fourth switching element having a control terminal coupled to the first scan signal line, a first terminal coupled to the first pole of the light-emitting device, and a second terminal coupled to the second power terminal.

7. The pixel driving circuit of claim 6, wherein the first switching element, the second switching element, the third switching element, the fourth switching element and the switching element are thin film transistors.

8. A display panel, comprising the pixel driving circuit of claim 2.

9. A display apparatus, comprising the display panel of claim 8.

10. The pixel driving circuit of claim 1, wherein the first input device comprises:

a first switching element having a control terminal coupled to the first scan signal line, a first terminal coupled to the data line, and a second terminal coupled to the first node.

11. A display panel, comprising the pixel driving circuit of claim 10.

12. A display apparatus, comprising the display panel of claim 11.

13. The pixel driving circuit of claim 1, wherein the second input device comprises:

a switching element having a control terminal coupled to the second scan signal line, a first terminal coupled to the first node, and a second terminal coupled to the second power terminal.

14. A display panel, comprising the pixel driving circuit of claim 13.

15. The pixel driving circuit of claim 1, wherein the isolation device comprises:

a switching element having a control terminal coupled to the second scan signal line, a first terminal coupled to the first power terminal and a second terminal coupled to the third node.

16. The pixel driving circuit of claim 1, wherein the reset device comprises:

a switching element having a control terminal coupled to the first scan signal line, a first terminal coupled to the first pole of the light-emitting device, and a second terminal coupled to the second power terminal.

17. The pixel driving circuit of claim 1, wherein the pixel driving circuit is coupled to scan signal lines of the $N^{th}$ row and the $(N+1)^{th}$ row, and wherein the scan signal line of the $N^{th}$ row is configured to output the first scan signal, and the scan signal line of the $(N+1)^{th}$ row is configured to output the second scan signal, N is a positive integer.

18. A pixel driving method for driving the pixel driving circuit of claim 1, wherein the pixel driving method comprises a reset stage, a compensation stage, a buffer stage, and a light-emitting stage, and wherein:

during the reset stage, the first input device, the compensation device, and the reset device are turned on under the control of the first scan signal, and the second input device and the isolation device are turned on under the control of the second scan signal, the reset device resets the first pole of the light-emitting device by using the second power signal, the first input device inputs the data signal to the first node, and the second input device inputs the first power signal to the second node;

during the compensation stage, the first input device, the compensation device, and the reset device are turned on under the control of the first scan signal, and a signal at the second node is discharged to a threshold voltage of the driving transistor through the compensation device, the driving transistor, and the reset device;

during the buffer stage, the first switching device, the compensation device, and the reset device are turned off under the control of the first scan signal, and the second input device and the isolation device are turned off under the control of the second scan signal, and the signals at the first node and the second node remain unchanged;

during the light-emitting stage, the second input device and the isolation device are turned on under the control of the second scan signal, and the data signal at the first node is written into the second node, so that the signal at the second node jumps to a sum of the data signal and the threshold voltage of the driving transistor, and the driving transistor is turned on under the control of the signal at the second node, and outputs a driving current under the control of the signal at the third node.

19. A display panel, comprising the pixel driving circuit of claim 1.

20. A display apparatus, comprising the display panel of claim 19.

* * * * *